US005478709A

United States Patent [19]

Vandenabeele

[11] Patent Number: 5,478,709

[45] Date of Patent: Dec. 26, 1995

[54] PHOTOGRAPHIC LIGHT-SENSITIVE MATERIAL APPLICABLE FOR RAPID PROCESSING

[75] Inventor: Hubert Vandenabeele, Mortsel, Belgium

[73] Assignee: AGFA-Gevaert, N.V., Mortsel, Belgium

[21] Appl. No.: 304,476

[22] Filed: Sep. 12, 1994

[30] Foreign Application Priority Data

Sep. 17, 1993 [EP] European Pat. Off. ..... 93202694

[51] Int. Cl.[6] ..... G03C 1/85

[52] U.S. Cl. ..... 430/527; 430/523; 430/608; 430/950; 430/961

[58] Field of Search ..... 430/523, 527, 430/608, 950, 961

[56] References Cited

U.S. PATENT DOCUMENTS

| | | | |
|---|---|---|---|
| 4,144,065 | 3/1979 | Lambert et al. | 430/212 |
| 4,173,480 | 11/1979 | Woodward | 430/536 |
| 4,230,792 | 10/1980 | Tsubai et al. | 430/302 |
| 4,891,306 | 1/1990 | Yokoyama et al. | 430/527 |
| 5,008,178 | 4/1991 | Van Thillo | 430/527 |
| 5,252,445 | 10/1993 | Timmerman et al. | 430/527 |

FOREIGN PATENT DOCUMENTS 0161411 11/1985 European Pat. Off. .

*Primary Examiner*—Thomas R. Neville
*Attorney, Agent, or Firm*—Breiner & Breiner

[57] ABSTRACT

A light-sensitive photographic silver halide material is disclosed comprising a support and on one or both sides thereof at least one silver halide emulsion layer, at least one gelatin antistress layer and, optionally, a substantially gelatin free antistatic surface layer coated thereover, characterised in that said emulsion layer(s) comprise(s) at least one synthetic clay. As a result the said material is less sensitive to roller marks in automatic processing machines.

8 Claims, No Drawings

PHOTOGRAPHIC LIGHT-SENSITIVE MATERIAL APPLICABLE FOR RAPID PROCESSING

FIELD OF THE INVENTION

The invention is related to a rapidly processable light-sensitive silver halide photographic material.

BACKGROUND OF THE INVENTION

As is well known in the field of radiography, there is a general trend to enhance the speed of processing. Therefore interest has been focused on rapid access of radiographs, being vital in diagnosis. By the manufacturing of films suitable for rapid processing applications an ideal balance has to be sought concerning the thickness of the coated hydrophilic layers and the obtained sensitivity within a short processing time. E.g. thicker gelatin layers provide a sufficient absorption of processing chemicals in favour of the degree of development which is attainable within short development times of e.g. about 12 seconds or less. An inevitable disadvantage however is the longer drying time required for thicker coatings as the water absorption is also enhanced in the rinsing stage of the processing cycle. On the other hand thinner, sufficiently hardened coatings may be dried within very short times.

Rapid processing conditions that can alternatively be applied are development processing at higher pH and higher temperatures of e.g. 30° to 40° C., to accelerate the said processing.

However thin coated layers as well as high temperature processing or processing in a developer medium having a higher pH bring about deterioration of the photographic images obtained. Especially in automatic processors it frequently occurs that the pressure resistance of the photographic materials is insufficient. In that case so-called roller marks appear due to the uneven pressure of the carrying or conveying rollers in the processing machine.

OBJECTS OF THE INVENTION

Therefor it is the main object of this invention to provide a photographic material that is free from roller marks, even at high speed processing cycles in automatic processors.

Other objects will become apparent from the description hereinafter.

SUMMARY OF THE INVENTION

It has been found that the said main object can be attained by a light-sensitive photographic silver halide material comprising a support and on one or both sides thereof at least one silver halide emulsion layer, characterised in that said silver halide emulsion layer(s) comprise(s) at least one synthetic clay.

DETAILED DESCRIPTION

Natural clays are essentially hydrous aluminum silicates, wherein alkali metals or alkaline-earth metals are present as principal constituents. Also in some clay minerals magnesium or iron or both replace the aluminum wholly or in part. The ultimate chemical constituents of the clay minerals vary not only in amounts, but also in the way in which they are combined or are present in various clay minerals. It is also possible to prepare synthetic clays in the laboratory, so that more degrees of freedom can lead to reproducible tailor made clay products for use in different applications.

So from the natural clays smectite clays, including laponites, hectorites and bentonites are well-known. For the said smectite clays some substitutions in both octahedral and tetrahedral layers of the crystal lattice occur, resulting in a small number of interlayer cations. Smectite clays form a group of "swelling" clays which take up water and organic liquids between the composite layers and which have marked cation exchange capacities.

From these smectite clays, synthetic chemically pure clays have been produced. So e.g. preferred synthetic smectite clay additives for the purposes of this invention are LAPONITE RD and LAPONITE JS, trade mark products of LAPORTE INDUSTRIES Limited, London. Organophilic clays and process for the production thereof have been described in EP-Patent 161 411 B1.

LAPONITE JS is described as a synthetic layered hydrous sodium lithium magnesium fluoro-silicate incorporating an inorganic polyphoshate peptiser. The said fluoro-silicate appears as free flowing white powder and hydrates well in water to give virtually clear and colourless colloidal dispersions of low viscosity, also called "sols". On addition of small quantities of electrolyte highly thixotropic gels are formed rapidly. The said thixotropic gels can impart structure to aqueous systems without significantly changing viscosity. An improvement of gel strength, emulsion stability and suspending power can be observed by making use of it in the said aqueous systems. Further advantages are the large solid surface area of about 350 $m^2/g$ which gives excellent adsorption characteristics, its stability over a wide range of temperatures, its unique capability to delay gel formation until desired and its synergistic behaviour in the presence of thickening agents. Further, its purity and small particle size ensures an excellent clarity. In aqueous solutions of many polar organic solvents it works as a very effective additive.

LAPONITE RD is described as a synthetic layered hydrous sodium lithium magnesium silicate with analogous properties as LAPONITE JS.

Laponite clay as a synthetic inorganic gelling agent for aqueous solutions of polar organic compounds has been presented at the Symposium on "Gums and Thickeners", organised by the Society of Cosmetic Chemists of Great Britain, held at Oxford, on Oct. 14, 1969. In Laporte Inorganics Laponite Technical Bulletin L104/90/A a complete review about the structure, the chemistry and the relationship to natural clays is presented. Further in Laporte Inorganics Laponite Technical Bulletin L106/90/c properties, preparation of dispersions, applications and the product range are disclosed. A detailed description of "Laponite synthetic swelling clay, its chemistry, properties and application" is given by B. J. R. Mayes from Laporte Industries Limited.

The light-sensitive material of the present invention comprises a support having on at least one side thereof at least one light-sensitive hydrophilic colloid silver halide emulsion layer wherein the synthetic swelling clays according to this invention are present as an extra binder or filler between the silver halide grains in addition to the hydrophilic colloid.

Specifically useful amounts of the said synthetic swelling clays are in the range from 0.05 to 1 g per $m^2$, more preferably from 0.05 to 0.75 g per $m^2$ and still more preferably from 0.1 to 0.5 $g/m^2$.

Quite unexpectedly it has been found that in the presence of the said clays according to this invention, roller mark defects as described hereinbefore are much reduced or are even absent if the said light-sensitive material is rapidly run in an automatic processor. Even if the amount of hydrophilic binder has been reduced to obtain thin coated, rapidly processable layers, the presence of the said synthetic swelling clays is working very efficiently against pressure marks that are induced by the conveying rollers in the processing of the said materials.

As the main hydrophilic binder in the hydrophilic layers of the photographic material conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). Before and during the formation of the silver halide grains it is common practice to establish a gelatin concentration of from about 0.05% to 5.0% by weight in the dispersion medium so that gelatin is already brought into the emulsion layer(s) by incorporation of silver halide crystals that are prepared in gelatinous medium. To minimize the amount of gelatin, the silver halide crystals can alternatively be prepared in silica sol medium as has been described in EP-A 319 019. Additional gelatin can be added in a later stage of the emulsion preparation, e.g. during the flocculation procedure, after washing or by redispersing the flocculate, to establish optimal coating conditions and/or to establish the required thickness of the coated emulsion layer. Preferably a gelatin/silver halide ratio, expressed as the equivalent amount of silver nitrate, ranging from 0.2 to 1.0 is then obtained.

Gelatin can, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

The gelatin binder of the photographic elements can be forehardened with appropriate hardening agents such as those of the epoxide type, those of the ethylenimine type, those of the vinylsulphone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EU Patent Application 408,143.

The halide composition of the silver halide emulsions used according to the present invention is not specifically limited and may be any composition selected from i.a. silver chloride, silver bromide, silver chlorobromide, silver bromoiodide, and silver chlorobromoiodide. The content of silver iodide is equal to or less than 20 mol%, preferably equal to or less than 5 mol%, even more preferably equal to or less than 3 mol%.

The photographic silver halide emulsions used according to the present invention can be prepared by mixing the halide and silver solutions in partially or fully controlled conditions of temperature, concentrations, sequence of addition, and rates of addition. The silver halide can be precipitated according to the single-jet method, the double-jet method, or the conversion method.

The silver halide particles of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in accordance with the present invention.

The average size of the silver halide grains may range from 0.1 to 2.0 μm, preferably from 0.1 to 1.0 μm and still more preferably from 0.2 to 0.6 μm.

The size distribution of the silver halide particles of the photographic emulsions to be used according to the present invention can be homodisperse or heterodisperse. A homodisperse size distribution is obtained when 95% of the grains have a size that does not deviate more than 30% from the average grain size.

The silver halide crystals can be doped with $Rh^{3+}$, $Ir^{4+}$, $Cd^{2+}$, $Zn^{2+}$, $Pb^{2+}$.

The photographic emulsions can be prepared from soluble silver salts and soluble halides according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion" The Focal Press, London (1966).

The emulsion can be desalted in the usual ways e.g. by dialysis, by flocculation and re-dispersing, or by ultrafiltration.

The light-sensitive silver halide emulsion can be a so-called primitive emulsion, in other words an emulsion that has not been chemically sensitized. However, the light-sensitive silver halide emulsion can be chemically sensitized as described i.a. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden"

edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB-A 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used.

The light-sensitive silver halide emulsions can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the cyanine dyes, merocyanine dyes, complex merocyanine dyes.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in US-A 3,457,078, nitrogen-containing heterocyclic ring-substituted aminostilbene compounds as described e.g. in US-A 2,933,390 and US-A 3,635,721, aromatic organic acid/formaldehyde condensation products as described e.g. in US-A 3,743,510, cadmium salts, and azaindene compounds.

The silver halide emulsion for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxy-s-triazolo-[1,5-a]-pyrimidines as described in US-A 4,727,017, and other compounds such as benzenethiosulphonic acid, benzenethiosulphinic acid, benzenethiosulphonic acid amide. Other compounds that can be used as fog-inhibiting compounds are metal salts such as e.g. mercury or cadmium salts and the compounds described in Research Disclosure N° 17643 (1978), Chaptre VI.

The fog-inhibiting agents or stabilizers can be added to the silver halide emulsion prior to, during, or after the ripening thereof and mixtures of two or more of these compounds can be used.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. US-A 3,038,805—4,038,075—4,292,400.

The photographic element of the present invention may further comprise various other additives such as e.g. compounds improving the dimensional stability of the photographic element, UV-absorbers, spacing agents, hardeners, and plasticizers.

Suitable additives for improving the dimensional stability of the photographic element are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins , and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids.

Suitable UV-absorbers are i.a. aryl-substituted benzotriazole compounds as described in US-A 3,533,794, 4-thiazolidone compounds as described in US-A 3,314,794 and 3,352,681, benzophenone compounds as described in JP-A 2784/71, cinnamic ester compounds as described in US-A 3,705,805 and 3,707,375, butadiene compounds as described in US-A 4,045,229, and benzoxazole compounds as described in US-A 3,700,455.

In general, the average particle size of spacing agents is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been desribed in US-A 4,614,708.

The silver halide emulsion layer(s) is(are) normally overcoated with a protected antistress layer. A preferred protective layer is made from gelatin hardened up to a degree corresponding with a water absorption of less than 2.5 grams of water per $m^2$. The gelatin coverage in the protective layer is preferably not higher than about 1.1 g per $m^2$ and is more preferably in the range of 1.20 to 0.60 g per $m^2$.

In admixture with the hardened gelatin the protective layer may contain friction-lowering substance(s) such as dispersed wax particles (carnaubawax or montanwax) or polyethylene particles, fluorinated polymer particles, silicon polymer particles etc.

According to a specific embodiment the friction lowering substance(s) are present in an antistatic layer on top of the antistress layer serving as outermost layer.

A common support of a photographic silver halide emulsion material is a hydrophobic resin support or hydrophobic resin coated paper support. Hydrophobic resin supports are well known to those skilled in the art and are made e.g. of polyester, polystyrene, polyvinyl chloride, polycarbonate, preference being given to polyethylene terephthalate. A preferred resin coated paper support is a poly-Alpha-olefin coated paper support such as a polyethylene coated paper support.

The hydrophobic resin support may be provided with one or more subbing layers known to those skilled in the art for adhering thereto a hydrophilic colloid layer. Suitable subbing layers for polyethylene terephthalate supports are described e.g. in US-P Nos. 3,397,988, 3,649,336, 4,123,278 and 4,478,907.

According to this invention in a preferred embodiment colloidal silica is added to the antistress layer composition on top of the silver halide emulsion layer(s). Preferably the said colloidal silica has an average particle size not larger than 10 nm, a surface area of at least 300 $m^2$ per gram. A coverage in the range of 50 mg to 500 mg per $m^2$ is used. Particularly good results can be obtained if in the protective antistress coating at least 50% by weight of colloidal silica versus the binder is present. Especially preferred colloidal silica particles have a surface area of 500 $m^2$ per gram and an average grain size smaller than 7 nm. Such type of silica is sold under the name KIESELSOL 500 (KIESELSOL is a registered trade name of Bayer AG, Leverkusen, West-Germany).

Further by making use of a layer composition wherein antistatic agents as e.g. polyoxyalkylenes and more preferably polyoxyethylenes are present in an outermost layer, the presence of at least one ionic or non-ionic polymer or copolymer latex or at least one synthetic clay as described hereinbefore contributes to the preservation of the antistatic characteristics of the material before processing.

Moreover the said layer composition provides excellent surface characteristics as sufficient surface glare and the absence of water spot defects after processing, in addition to the improvement of pressure marks from the rollers in automatic processing machines which was the main object of this invention.

Photographic silver halide emulsion materials containing a silver halide emulsion layer according to the present invention may be of any type known to those skilled in the art. For example, the hydrohilic silver halide emulsion layer(s) is(are) useful in continuous tone or halftone photography, microphotography and radiography, in black-and-white as well as colour photographic materials.

By using a recording material having (a) silver halide emulsion layer(s) with a composition according to the present invention characterized by thin coated layers with reduced amounts of water absorption in the said composition the problems caused by roller marks in automatic processing machines with rapid processing cycles can be avoided or substantially reduced as will be illustrated in the Examples given hereinafter.

EXAMPLES

Example 1

A photographic silver iodobromide emulsion containing 2.0 mole % of silver iodide was prepared by a conventional single jet method in a vessel containing 40 g of phthaloyl gelatin. The ammoniacal silver nitrate solution was held at 42° C. as well as the emulsion vessel, containing the halide salts. At a constant rate of 300 ml per minute the precipitation time was ended after 10 minutes and followed by a physical ripening time of 40 minutes. After that time an additional amount of 20 g of gelatin was added. The obtained emulsion was of an average grain size of 0.62 μm and contained an amount of silver halide corresponding to approximately 90 g of silver nitrate per kg of the dispersion after addition of 3 moles of silver nitrate.

After addition of sulphuric acid to a pH value of 3.5 stirring was stopped and after sedimentation the supernatant liquid was removed. The washing procedure was started after a scrape-rudder was installed and after addition of polystyrene sulphonic acid in the first turn to get a quantitative flocculate without silver losses.

During the redispersion of the emulsion 150 g of gelatin were added so that the weight ratio of gelatin to silver halide expressed as silver nitrate was 0.40, the emulsion containing an amount of silver bromoiodide equivalent with 190 g of silver nitrate per kg.

The emulsion was chemically ripened with sulphur and gold compounds at 47° C. for 4 hours to get an optimized relation between fog and sensitivity and was stabilized with 4-hydroxy-6-methyl-1,3,3a-tetrazaindene before coating on both sides of a polyester support of 175 μm thickness. A protective layer was coated thereover with a coating amount of 1.1 g of gelatin per $m^2$. Per side coating amounts of silver halide crystals, expressed as the equivalent amount of silver nitrate and of gelatin in the emulsion layer were: 4.41 $g/m^2$ and 1.05 $g/m^2$ respectively.

The film was exposed to light through a step wedge before processing to make the evaluation more realistic. The exposed radiographic materials were processed in the processing machine CURIX HT530 (Agfa-Gevaert trademarked name) with the following time (in seconds) and temperature (in ° C.) characteristics:

| | | |
|---|---|---|
| loading: | 0.2 sec. | |
| developing: | 9.3 sec. | 35° C. in developer I described below |
| cross-over: | 1.4 sec. | |
| rinsing: | 0.9 sec. | |
| cross-over: | 1.5 sec. | |
| fixing: | 6.6 sec. | 35° C. in fixer I described below |
| cross-over: | 2.0 sec. | |
| rinsing: | 4.4 sec. | 20° C. |
| cross-over: | 4.6 sec. | |
| drying: | 6.7 sec. | |
| total | 37.6 sec. | |

-continued

| Composition of Developer I: | |
|---|---|
| concentrated part: | |
| water | 200 ml |
| potassium bromide | 12 grams |
| potassium sulphite (65% solution) | 249 grams |
| ethylenediaminetetraacetic acid, sodium salt, trihydrate | 9.6 grams |
| hydroquinone | 106 grams |
| 5-methylbenzotriazole | 0.076 grams |
| 1-phenyl-5-mercaptotetrazole | 0.040 grams |
| sodiumtetraborate (decahydrate) | 70 grams |
| potassium carbonate | 38 grams |
| potassium hydroxide | 49 grams |
| diethylene glycol | 11 grams |
| potassium iodide | 0.088 grams |
| 4-hydroxymethyl-4methyl-1phenyl-3-pyrazolidinone | 12 grams |
| Water to make 1 liter | |

pH adjusted to 11.15 at 25° C. with potassium hydroxide.

For initiation of the processing one part of the concentrated developer was mixed with 3 parts of water.

No starter was added.

The pH of this mixture was 10.30 at 25° C.

| Composition of the fixer: | |
|---|---|
| concentrated part: | |
| ammonium thiosulfate (78% solution) | 661 grams |
| sodium sulphite | 54 grams |
| boric acid | 25 grams |
| sodium acetate-trihydrate | 70 grams |
| acetic acid | 40 grams |
| water to make 1 liter | |

pH adjusted with acetic acid to 5.30 at 25° C.

To make this fixer ready for use one part of this concentrated part was mixed with 4 parts of water. A pH of 5.25 was measured at 25° C.

To reinforce the pressure mark defects the position of the conveying rollers was not optimized but made uneven.

The developing bath used had a pH of 10.1 and comprised the following ingredients per liter

| | |
|---|---|
| hydroquinone | 120 g |
| 1-phenyl-3-pyrazolidine-1-one | 6 g |
| 5-nitroindazole | 1 g |
| methyl-6-benztriazole | 0.36 g |

The following data are listed in table 1:

Coating No.

Amounts (amt.) of LAPONITE additive expressed in g per $m^2$ in emulsion layer (Em. L.) and in the protective antistress layer (A.S.L.)

Evaluation of roller marks (figures from 1 to 5):

the said roller marks are disturbing black stripes that were evaluated qualitatively as follows:

1=presence of very few roller marks

2=presence of few roller marks

3=presence of roller marks just tolerable for practical use

4=presence of many roller marks

5=presence of too much roller marks

TABLE 1

| Coating No. | LAPONITE JS amt. in EM. L. | LAPONITE JS amt. in A.S. L. | Roller Marks |
|---|---|---|---|
| 1 | 0 | 0 | 2 |
| 2 | 0.15 | 0 | 1 |
| 3 | 0 | 0.15 | 2 |

As can be derived from Table 1 the addition of the synthetic hectorite LAPONITE JS brings about an improvement in roller marks (press sensitivity) if the said additive is present in the emulsion layer. No effect is detected if LAPONITE JS is added to the protective antistress layer.

Example 2

Samples were coated as in Example 1 but with varying amounts of gelatin in the emulsion layer in order to make the ratio by weight change between the total amount of gelatin and the total amount of silver halide, expressed as silver nitrate.

Values of this ratio, called GESI, are summarized in Table 2 in addition of the data summarized as in Table 1.

Moreover the amount of water absorption for the double side coated materials, expressed in g $H^2O/m^2$ is given. The said amount was determined following the procedure described hereinafter:

exposing the film to light in order to have maximum densities over the whole film surface after processing, processing the film as described hereinbefore, taking the film out of the CURIX HT530 processor after the rinsing unit, before entering into the drying station, sucking up the excessive amounts of water present on top of the outermost layers, immediately determining the weight of the wet film, drying the film in the drying unit of the CURIX HT530 processor, immediately determining the weight of the film after the film has left the processor, calculating the measured weight differences between the wet and the dry film per square meter.

This procedure was followed 2 weeks after coating to allow the materials to be hardened to a constant level.

TABLE 2

| Coating No. | LAPONITE JS amt. in EM. L. | GESI | Water Absorption | Roller Marks |
|---|---|---|---|---|
| 4 | 0 | 0.35 | 11.4 | 4 |
| 5 | 0 | 0.30 | 10.9 | 5 |
| 6 | 0.316 | 0.30 | 9.4 | 3 |

As can be derived from Table 2 the addition of the synthetic hectorite LAPONITE JS brings about an improvement in roller marks (pressure sensitivity) if the said additive is present in the emulsion layer, even for lower weight ratios of gelatin to silver halide. A lowering of the GESI value indicates that the emulsion coating is made thinner and as a result a lowering of the water absorption is also measured. Even for thinner coatings the improvement of the roller marks is thus remarkable.

Example 3

Samples were coated as in Example 2 at a GESI of 0.3. LAPONITE RD was added to the emulsion layer of the materials in variable amounts as summarized in Table 3. Values of water absorption, measured as described in Example 2 were also given.

TABLE 3

| Coating No. | LAPONITE RD amt. in EM. L. | GESI | Water Absorption | Roller Marks |
|---|---|---|---|---|
| 7 (comp.) | 0 | 0.30 | 9.1 | 5 |
| 8 (inv.) | 0.08 | 0.30 | 9.0 | 3–4 |
| 9 (inv.) | 0.16 | 0.30 | 8.7 | 3 |

As can be derived from Table 3 the addition of the synthetic hectorite LAPONITE RD brings about an improvement in roller marks (pressure sensitivity) if the said additive is present in the emulsion layer, even for lower weight ratios of gelatin to silver halide and low water absorption values detected for the thin coated layers. The higher the amounts of the said additive, the more remarkable is the improvement, practically without changing the amount of water absorption after processing.

I claim:

1. A light-sensitive photographic silver halide material comprising a support and on one or both sides thereof at least one silver halide emulsion layer, characterised in that said silver halide emulsion layer(s) comprise(s) at least one synthetic clay.

2. A light-sensitive photographic silver halide material according to claim 1, wherein said synthetic clay is a synthetic smectite clay.

3. A photographic silver halide material according to claim 1, wherein the amount of synthetic clay present in the silver halide emulsion layer(s) is from 0.05 to 0.75 $g/m^2$.

4. A photographic silver halide material according to claim 1, wherein the amount of synthetic clay present in the silver halide emulsion layer(s) is from 0.1 to 0.5 $g/m^2$.

5. A photographic silver halide material according to claim 1, wherein an antistress layer or layers, comprising an amount of gelatin of less than 1.2 $g/m^2$ is present on top of the emulsion layer(s).

6. A photographic silver halide material according to claim 5, wherein colloidal silica is present in the antistress layer(s) in an amount of 50 to 500 $mg/m^2$.

7. A photographic silver halide material according to claim 6, wherein the colloidal silica particles have a surface area of 500 $m^2$ per gram and an average grain size smaller than 7 nm.

8. A photographic material according to claim 1, wherein said photographic material is a medical X-ray material.

* * * * *